US011653700B2

(12) United States Patent
Liu

(10) Patent No.: US 11,653,700 B2
(45) Date of Patent: May 23, 2023

(54) ELECTRONIC CIGARETTE COMPRISING DISPOSABLE AND DETACHABLE CLEAROMIZER

(71) Applicant: Tuanfang Liu, Shenzhen (CN)

(72) Inventor: Tuanfang Liu, Shenzhen (CN)

( * ) Notice: Subject to any disclaimer, the term of this patent is extended or adjusted under 35 U.S.C. 154(b) by 343 days.

(21) Appl. No.: 17/013,890

(22) Filed: Sep. 8, 2020

(65) Prior Publication Data

US 2021/0186102 A1 Jun. 24, 2021

(30) Foreign Application Priority Data

Dec. 18, 2019 (CN) ..... 201922307010.0

(51) Int. Cl.

| | |
|---|---|
| ***A24F 40/10*** | (2020.01) |
| ***A24F 40/40*** | (2020.01) |
| ***A24F 40/42*** | (2020.01) |
| ***A24F 40/44*** | (2020.01) |
| ***A24F 40/46*** | (2020.01) |
| ***H05B 1/02*** | (2006.01) |
| ***H05B 3/44*** | (2006.01) |

(52) U.S. Cl.

CPC ..... *A24F 40/42* (2020.01); *A24F 40/10* (2020.01); *A24F 40/44* (2020.01); *A24F 40/46* (2020.01); *H05B 1/0297* (2013.01); *H05B 3/44* (2013.01)

(58) Field of Classification Search

CPC ..... A24F 40/10; A24F 40/40; A24F 40/42; A24F 40/44; A24F 40/46; H05B 1/0227; H05B 1/0297; H05B 3/44

See application file for complete search history.

(56) References Cited

U.S. PATENT DOCUMENTS

| | | | | |
|---|---|---|---|---|
| 10,279,934 | B2 * | 5/2019 | Christensen | B65B 3/18 |
| 10,542,780 | B2 * | 1/2020 | Chung | A24F 40/485 |
| 2015/0305408 | A1 * | 10/2015 | Liu | H05B 3/06 392/404 |
| 2016/0044964 | A1 * | 2/2016 | Liu | A24F 40/42 392/398 |
| 2020/0154789 | A1 * | 5/2020 | Novak, III | H02J 7/0031 |

FOREIGN PATENT DOCUMENTS

| | | | | |
|---|---|---|---|---|
| WO | WO-2016041209 A1 * | 3/2016 | | A24F 47/00 |
| WO | WO-2016149896 A1 * | 9/2016 | | A24F 47/00 |

* cited by examiner

*Primary Examiner* — Abdullah A Riyami
*Assistant Examiner* — Thang H Nguyen
(74) *Attorney, Agent, or Firm* — Matthias Scholl P.C.; Matthias Scholl

(57) ABSTRACT

An electronic cigarette, including an atomization assembly and a battery assembly. The atomization assembly includes a clearomizer. The clearomizer includes a first sealing gasket, an e-liquid storage tank, a second sealing gasket, and a heating module. The first sealing gasket and the second sealing gasket are disposed on two ends of the e-liquid storage tank, respectively. The beating module is disposed in the e-liquid storage tank and between the first sealing gasket and the second sealing gasket.

4 Claims, 5 Drawing Sheets

ELECTRONIC CIGARETTE COMPRISING DISPOSABLE AND DETACHABLE CLEAROMIZER

CROSS-REFERENCE TO RELATED APPLICATIONS

Pursuant to 35 U.S.C. § 119 and the Paris Convention Treaty, this application claims foreign priority to Chinese Patent Application No. 201922307010.0 filed Dec. 18, 2019, the contents of which, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, Mass. 02142.

BACKGROUND

The disclosure relates to an electronic cigarette.

A conventional electronic cigarette includes an atomization assembly and a battery assembly. The atomization assembly comprises a piece of common cotton which cannot hold the e-liquid and is easily burned out. In addition, the atomization assembly comprises a fixed clearomizer which is undetachable.

SUMMARY

The disclosure provides an electronic cigarette comprising an atomization assembly and a battery assembly; the atomization assembly comprises a clearomizer; the clearomizer comprises a first sealing gasket, an e-liquid storage tank, a second sealing gasket, and a heating module; the first sealing gasket and the second sealing gasket are disposed on two ends of the e-liquid storage tank, respectively; the heating module is disposed in the e-liquid storage tank and between the first sealing gasket and the second sealing gasket.

The heating module comprises a fiberglass tube, a heating wire, and a strip of cotton; the heating wire is disposed in the fiberglass tube; the strip of cotton is wrapped around the fiberglass tube.

The fiberglass tube comprises a sleeve and a glass fiber tube; the heating wire is horizontally disposed on the glass fiber tube; and the sleeve is wrapped around the glass fiber tube to fix the heating wire.

The sleeve is fixed on the first sealing gasket and the glass fiber tube is fixed on the second sealing gasket for air conduction.

The first sealing gasket is disposed on a bottom of a mouthpiece of the electronic cigarette, and a lower end of the second sealing gasket is disposed in a housing of the electronic cigarette.

The e-liquid storage tank is transparent.

The atomization assembly is disposed on the battery assembly. The atomization assembly comprises a clearomizer which is disposable and can be detached from the electronic cigarette for replacement. The atomization assembly comprises a strip of cotton which can fully absorb and hold the e-liquid thereby preventing the heating wire from carbonization under high temperature.

DETAILED DESCRIPTION

To further illustrate, embodiments detailing an electronic cigarette are described below. It should be noted that the following embodiments are intended to describe and not to limit the disclosure.

Figure 1:
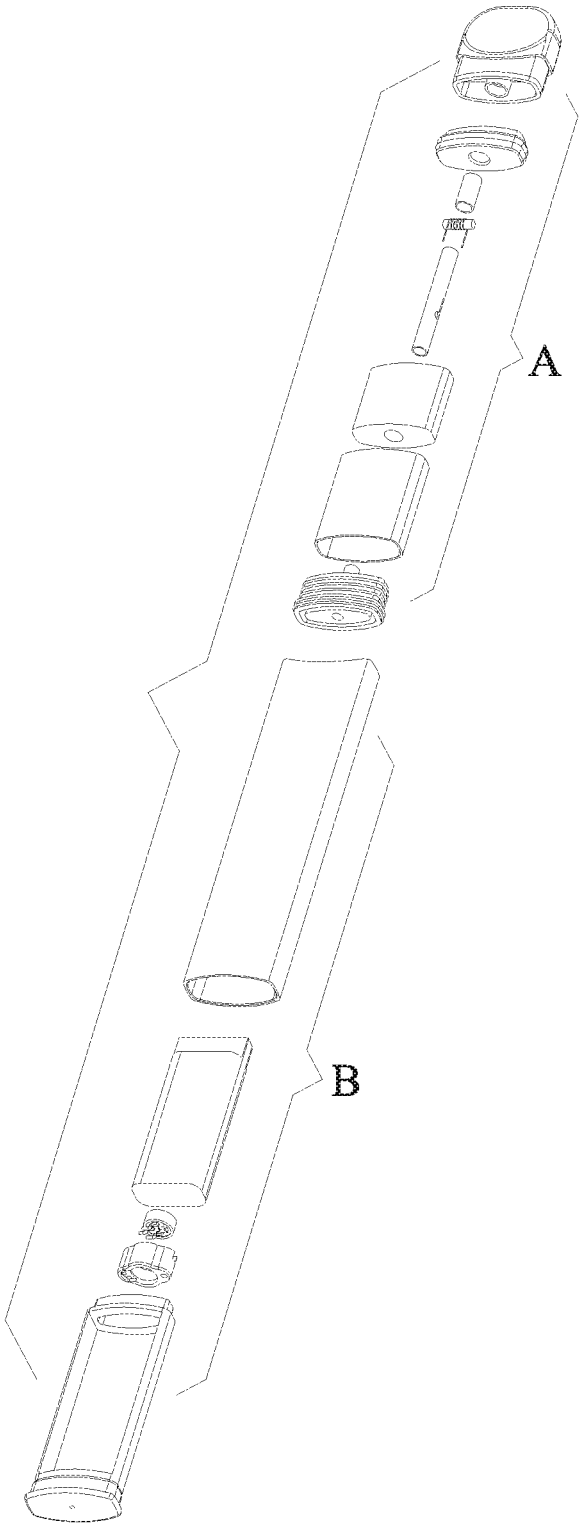
FIG. 1 is an exploded view of an electronic cigarette according to one embodiment of the disclosure.
Figure 2:
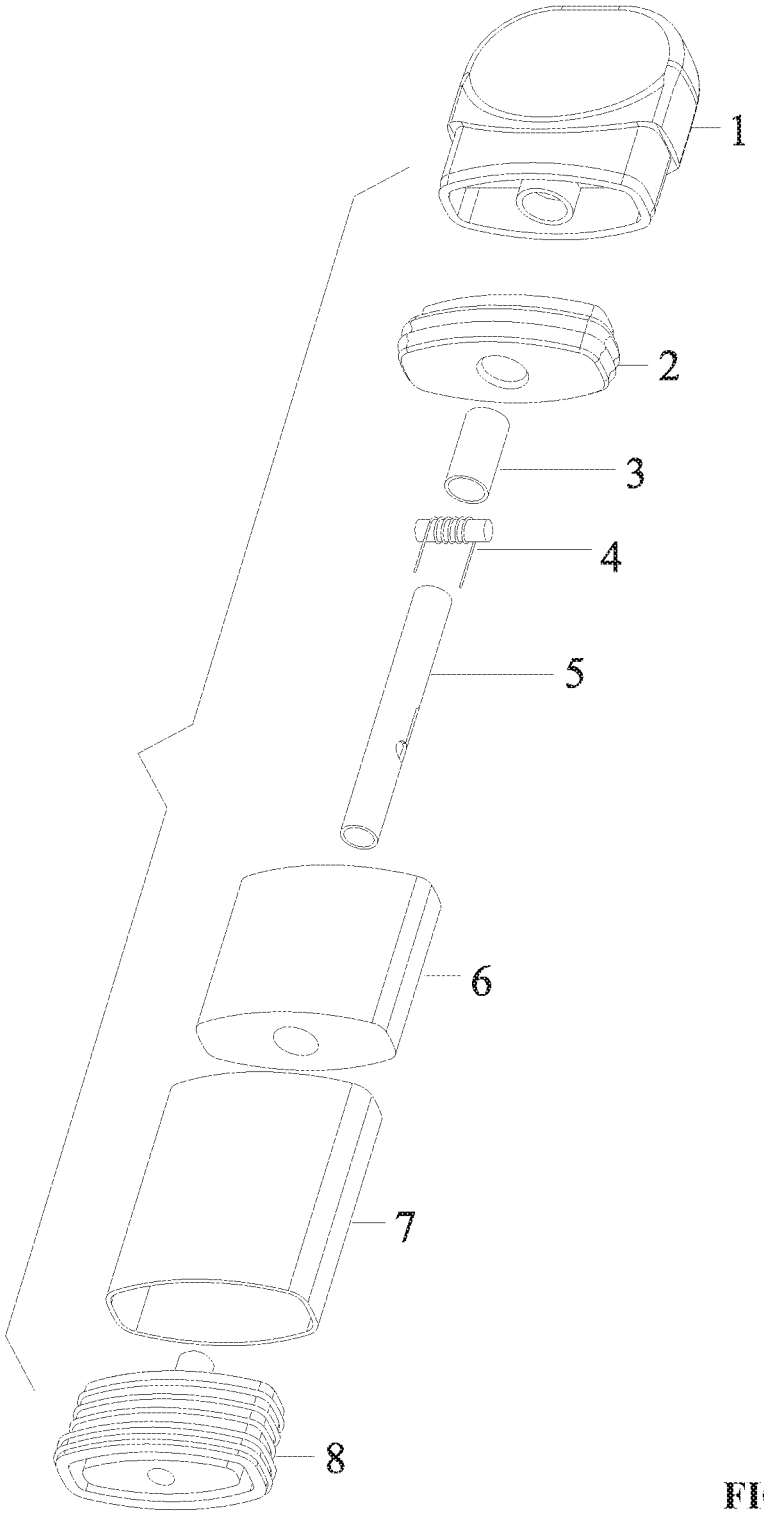
FIG. 2 is an exploded view of an atomization assembly of an electronic cigarette in FIG. 1.
Figure 3:
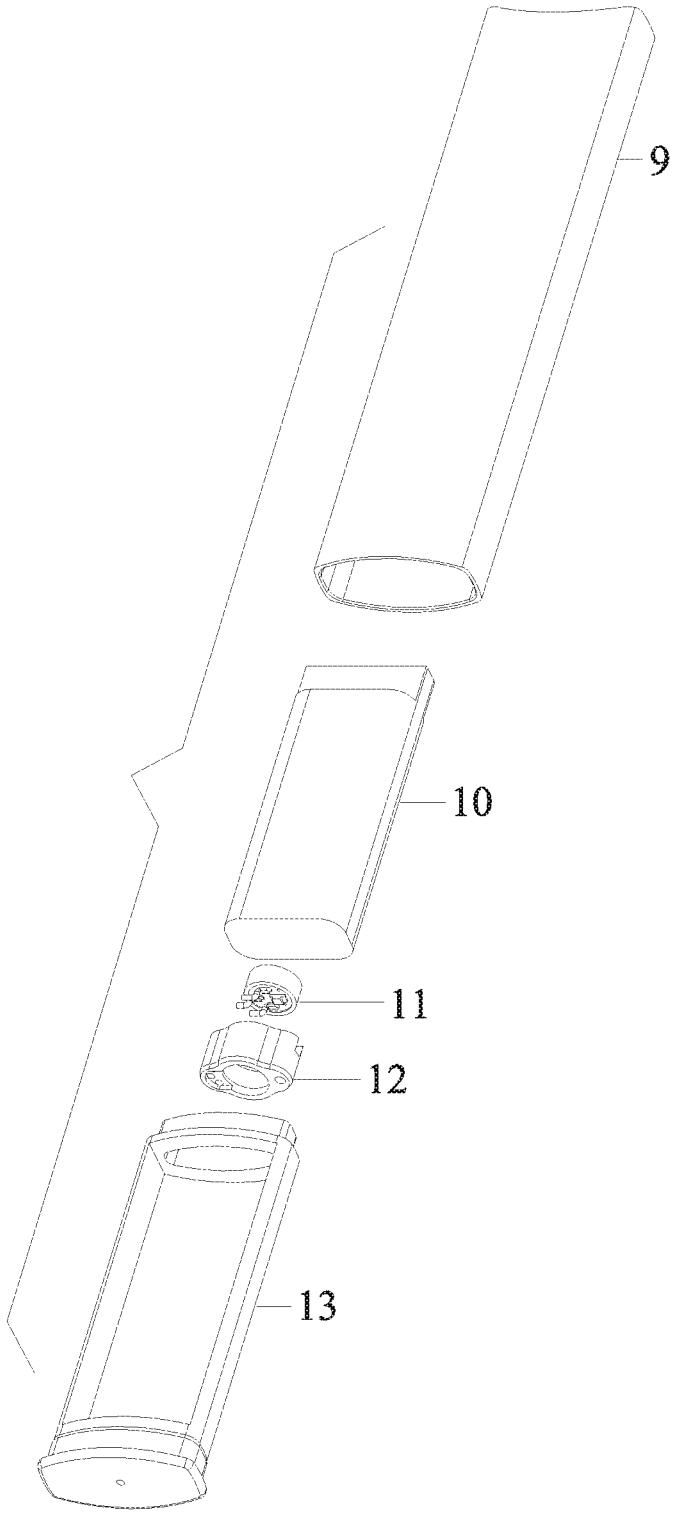
FIG. 3 is an exploded view of a battery assembly of an electronic cigarette in FIG. 1.
Figure 4:
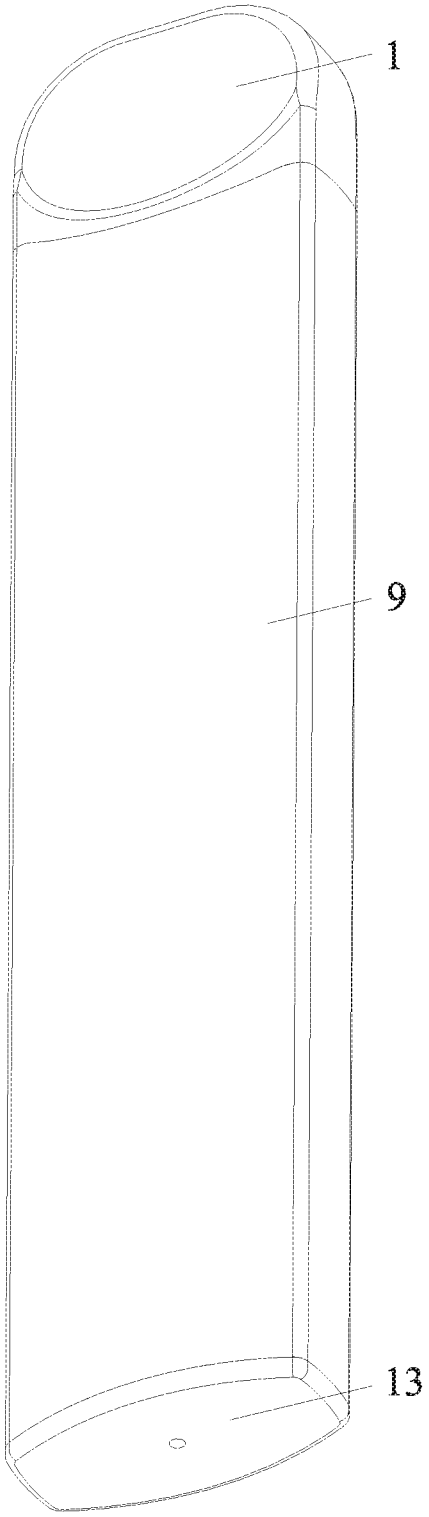
FIG. 4 is a schematic diagram of an electronic cigarette according to one embodiment of the disclosure.
Figure 5:
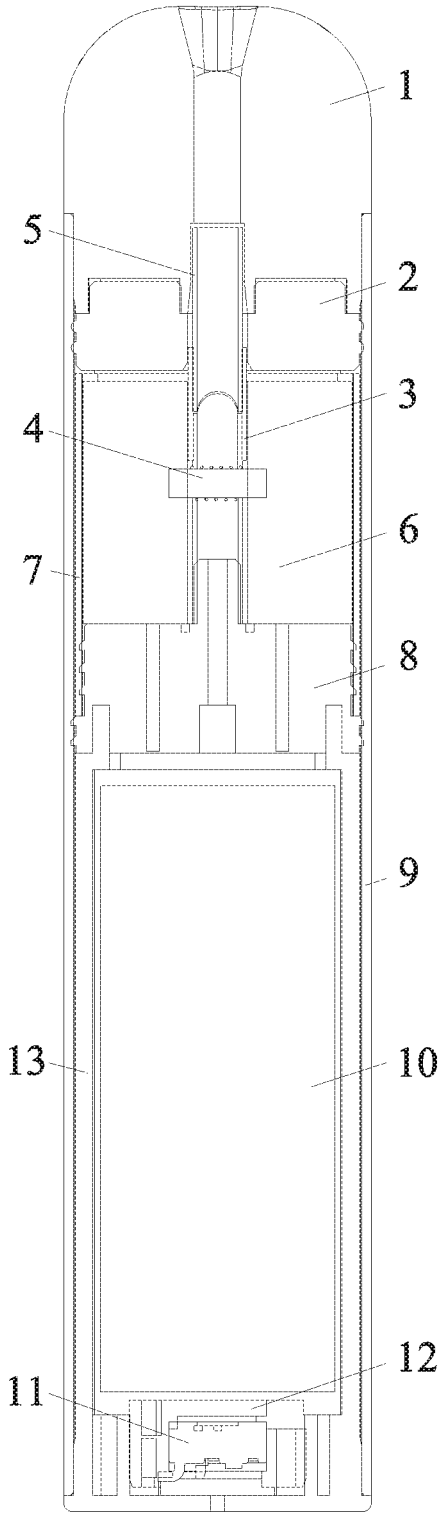
FIG. 5 is a sectional view of an electronic cigarette according to one embodiment of the disclosure.

As shown in FIGS. 1-5, the disclosure provides an electronic cigarette comprising an atomization assembly A and a battery assembly B. The atomization assembly comprises a mouthpiece 1, a first sealing gasket 2, a sleeve 3, a beating wire 4, a glass fiber tube 5, a strip of cotton 6, an e-liquid storage tank 7, and a second sealing gasket 8. The heating wire 4 is horizontally disposed on the glass fiber tube 5; and the sleeve 3 is wrapped around the glass fiber tube 5 to fix the heating wire 4. The strip of cotton 6 is wrapped around the glass fiber tube 5. The glass fiber tube 5 is fixed on the second sealing gasket 8 for air conduction. The first sealing gasket 2 and the second sealing gasket 8 are disposed on two ends of the e-liquid storage tank 7, respectively: the heating module is disposed in the e-liquid storage tank 7 and between the first sealing gasket 2 and the second sealing gasket 8. The above components form a clearomizer. The clearomizer is disposed in the bottom of the mouthpiece 1. Specifically, the first sealing gasket 2 is disposed around the bottom of the mouthpiece 1.

The battery assembly B comprises a housing 9, a battery 10, a pneumatic switch 11, a silicone ring 12, and a support 13. The silicone ring 12 is disposed around the pneumatic switch 11. The input end of the pneumatic switch 11 is electronically connected to the battery 10. The battery is disposed in the support 13. The support 13 is disposed in the housing 9.

The atomization assembly A is disposed on the battery assembly B. The input end of the clearomizer is soldered on the output end of the pneumatic switch 11.

It will be obvious to those skilled in the art that changes and modifications may be made, and therefore, the aim in the appended claims is to cover all such changes and modifications.

What is claimed is:

1. An electronic cigarette, comprising an atomization assembly and a battery assembly, the atomization assembly comprising a clearomizer; wherein:

the clearomizer comprises a first sealing gasket, an e-liquid storage tank, a second sealing gasket, and a heating module;

the first sealing gasket and the second sealing gasket are disposed on two ends of the e-liquid storage tank, respectively;

the heating module is disposed in the e-liquid storage tank, and between the first sealing gasket and the second sealing gasket, and comprises a heating wire, a strip of cotton, a sleeve and a glass fiber tube;

the heating wire is horizontally disposed on the glass fiber tube;

the sleeve is wrapped around the glass fiber tube to fix the heating wire; and the strip of cotton is wrapped around the glass fiber tube.

2. The electronic cigarette of claim 1, wherein the sleeve is fixed on the first sealing gasket and the glass fiber tube is fixed on the second sealing gasket for air conduction.

3. The electronic cigarette of claim 2, wherein the first sealing gasket is disposed on a bottom of a mouthpiece of the electronic cigarette, and a lower end of the second sealing gasket is disposed in a housing of the electronic cigarette.

4. The electronic cigarette of claim 3, wherein the e-liquid storage tank is transparent.

* * * * *